US009562379B2

(12) United States Patent
Olsen

(10) Patent No.: US 9,562,379 B2
(45) Date of Patent: Feb. 7, 2017

(54) SAFETY DOOR

(76) Inventor: David Paul Olsen, Los Angeles, CA (US)

( * ) Notice: Subject to any disclaimer, the term of this patent is extended or adjusted under 35 U.S.C. 154(b) by 2008 days.

(21) Appl. No.: 11/647,098

(22) Filed: Dec. 28, 2006

(65) Prior Publication Data

US 2008/0157541 A1 Jul. 3, 2008

(51) Int. Cl.

| | |
|---|---|
| ***E05C 9/10*** | (2006.01) |
| ***E05C 9/06*** | (2006.01) |
| ***E05C 9/16*** | (2006.01) |

(52) U.S. Cl.

CPC . *E05C 9/06* (2013.01); *E05C 9/16* (2013.01); *Y10T 70/5265* (2015.04); *Y10T 292/0837* (2015.04); *Y10T 292/0845* (2015.04)

(58) Field of Classification Search

CPC ..... E05C 9/06; E05C 9/16; Y10T 292/0837; Y10T 292/0845; Y10T 70/5265

USPC ..... 292/32, 38–39, 37, 42, 49, 1, 3, 40; 109/59 R

See application file for complete search history.

(56) References Cited

U.S. PATENT DOCUMENTS

| | | | | |
|---|---|---|---|---|
| 1,366,015 | A * | 1/1921 | Morris | E05C 9/06 292/5 |
| 2,460,961 | A * | 2/1949 | Wilson | 292/48 |
| 2,921,461 | A * | 1/1960 | Schlage | E05B 63/08 292/337 |
| 2,947,160 | A * | 8/1960 | Wolters | 70/1.5 |
| 4,046,410 | A * | 9/1977 | Connell | 292/36 |
| 4,288,944 | A * | 9/1981 | Donovan | E05C 9/042 292/39 |
| 4,306,432 | A | 12/1981 | Ravid | |
| 4,362,328 | A | 12/1982 | Tacheny et al. | |
| 4,754,715 | A * | 7/1988 | Squires | E05B 65/0075 109/59 T |
| 4,757,715 | A * | 7/1988 | Miwa et al. | 73/602 |
| 5,077,992 | A | 1/1992 | Su | |
| 5,094,483 | A * | 3/1992 | James | 292/39 |
| 5,110,164 | A | 5/1992 | Whiteman et al. | |
| 5,472,246 | A | 12/1995 | Puric | |
| 5,498,038 | A | 3/1996 | Simon et al. | |
| 5,595,076 | A | 1/1997 | Weinerman et al. | |
| 5,603,234 | A | 2/1997 | Lozier et al. | |
| 7,387,076 | B2 * | 6/2008 | Bauman et al. | 109/59 R |

FOREIGN PATENT DOCUMENTS

| | | |
|---|---|---|
| GB | 276634 | 5/1928 |
| GB | 1 563 393 | 3/1980 |

* cited by examiner

*Primary Examiner* — Kristina Fulton
*Assistant Examiner* — Nathan Cumar
(74) *Attorney, Agent, or Firm* — Alston & Bird LLP

(57) ABSTRACT

To cause a door from being forced open or broken to gain access, a safety door comprises a central actuator and a plurality of bars radially extending at spaced apart locations from said central actuator sufficient in number and spacing to reinforce substantially the entire door. The central actuator is pivotally mounted within the door and each of the plurality of bars has one of its ends pivotally mounted to the actuator to cause the bars to be retracted or extended by rotation of the actuator. There are at least four bars with at least one bar extending in each of the four sides of the door framework.

8 Claims, 6 Drawing Sheets

24
26B
26C
36C
32
28
36D
26D
36E
26E
36F
36B
36A
20B
30
26A
20A
26F
20F
36C
36B
50C
32
36D
36A
50D
50B
50A
36E
36F
50E
50F
26C
21C
20C
21B
26B
20B
34C
34B
26A
20D
20A
21A
21D
26D
28
34D
30
20E
21E
26E
20F
21F
26F
34E
34F
34A

SAFETY DOOR

BACKGROUND OF THE INVENTION

This invention relates to safety doors and more particularly to doors that resist forced entry from outside such as for example by forcing a deadbolt that is holding the door to the doorway frame to release or forcing the hinges from the door or doorway frame.

It is known to utilize multiple spaced apart deadbolts that resist forcible entry. This prior art technique has several disadvantages, such as for example: (1) the deadbolts only protrude a short distance into the frame of the door and thus can be forced free; (2) it is time consuming and inconvenient to individually move the deadbolts into place; and (3) the hinges can be forced out of the frame or the center of the door can be broken into such as by an axe.

U.S. Pat. No. 5,911,763 discloses a central actuator that moves a plurality of deadbolts into place at spaced apart locations around the periphery of the door through individual linkages, thus reducing the inconvenience of moving individual deadbolts into place one at a time. However, the lock disclosed in this patent relies upon linkages near the deadbolts at the periphery of the door that activate the three individual deadbolts and the deadbolts have only a short length within the door. It has several disadvantages, such as: (1) there are no deadbolts on the hinge side of the door so there are only a few short screws holding this side of the door in place against an impact that may pull the screws holding the hinges free; and (2) each of the linkage mechanisms includes three pivot points from the central actuator and provides little support for the door itself. Thus, in the case of some doors, an axe may be used to break the door itself.

It is known to use bars mountable on the inside of the door and held at several locations so that they extend across the door. While these bars provide overall strength, it is time consuming to put them in place and remove them when locking or unlocking the door. Moreover, they are unsightly.

SUMMARY OF THE INVENTION

Accordingly, it is an object of the invention to provide a novel safety door.

It is a further object of the invention to provide a novel method for securing a door.

It is a further object of the invention to provide a novel door that resists forced entry from impact such as kicking, hitting with a sledge hammer or prying with crowbars or the like.

It is a still object of the invention to provide a door that resists entry by cutting or penetrating means such as saws and blowtorches and the like.

It is a still further object of the invention to provide a novel door with sufficient strength to resist entry over the entire entrance and yet may be opened and closed in a normal manner.

It is a still further object of the invention to provide a novel safety door without excessive external appliances such as extra cages or bars or the like that must be individually placed to prevent easy entry.

It is a still farther object of the invention to provide a relatively inexpensive yet strong safety door.

It is a still further object of the invention to provide a safety door that can be tailored to the needs in terms of strength and ability to easily lock and unlock it.

In accordance with the above and further objects of the invention, the safety door includes a central actuator and a plurality of bars extending substantially radially from the centrally located actuator sufficiently far to protrude into the frame of the door. In the preferred embodiment, the centrally located actuator is substantially cylindrical and rotatably mounted to a central location on the door. It pivotably receives one end portion of each of the bars at spaced apart locations. A turn of the centrally located actuator through a relatively short number of degrees forces the bars into the frame or withdraws them from the frame of the door. There are at least four radially extending bars and preferably six radially extending bars relatively evenly annularly spaced about the centrally located actuator so that substantially the entire door is reinforced by the bars and the bars extend a substantial distance into the doorway frame.

The door itself may be fabricated of any of several different materials including metal with a fire-resistant internal filling or a wooden frame with an internal powder filling or be entirely wooden. It has been found that it is most economical for the door to contain a large percentage of wood because this slows steel cutting saws. The door should also be sufficiently solid to support the centrally-located actuator and the radially-extending bars. For this purpose, the core of the door must be capable of being drilled and routered at least over a substantial area to allow placement of the component parts of the actuator and bars. One of the less expensive types of such doors is a frame filled with pressed wood particles. Cores of wood are hereinafter at times referred to as wooden door cores.

In fabricating the door, the door may be placed horizontally on a surface such as a table top. Drills on runners may be attached to the table or other surface and then caused to drill holes radially inwardly for the bars. At a central location where the drilled holes meet, an opening must be drilled through the plane of the door to support the rotatably mounted actuator on the inside of the door. In the preferred embodiment, the bars are internal to the door but it is possible to mount them externally by other slidable means on the inside of the door. However, in the preferred embodiment, access to the locking mechanism is provided only from inside the door and not from the external side. The openings for the bars can be accomplished with a router by forming the radial slots or by drilling. They should be slightly larger in at least one radial direction than the bars since they will move laterally to a slight extent as well as radially.

In the preferred embodiment, the central actuator is wheel-shaped and includes circumferentially spaced-apart metal pins perpendicular to the plane of the door. Each of the pins connects the opening in an end portion of a corresponding rod to a circumferentially spaced pin opening in the actuator. Preferably, there are four or more such pins and six or more rods. The radial movement of the pins with the centrally located actuator moves the rods outwardly and inwardly. The end plate on the wheel conceals the pins and the end connections in the preferred embodiment. In one embodiment, a handle is provided to actuate the wheel from the outside. The handle may contain a lock or may be removable to provide security.

Two problems had to be solved to provide an easy to use, adaptable safety door.

Firstly, because the bars that serve as deadbolts and reinforcement for the door are actuated by a rotary actuator, they move both longitudinally and at an angle to their longitudinal axes within a solid door in a plane parallel to the doorway. Thus the door must include unsymmetrical openings in the door, door frame and floor with space at an angle to the longitudinal axes of the rods within a plane parallel to the doorway to permit movement of the bars. Secondly, the actuator must be easily rotated by hand even though it may move several long bars along frictional paths in some applications. Once these two unobvious problems were appreciated, they were solved by designing the safety door so that a minor amount of rotation in degrees would move a sufficient number of bars a sufficient distance into the doorway frame and/or floor to provide the required strength and an adequate mechanical advantage was obtained by proper selection of the actuator diameters. The diameters are the diameter of the circle of rotation of the handle of the actuator and the circle of rotation of the driving element for the bars.

From the above summary, it can be understood that the safety door and method of securing a door of this invention has several advantages, such as: (1) it has overall strength so as to resist battering by any mechanisms at any place; (2) it is difficult to locate and to break the points of attachment of the door and the frame; (3) the points of attachment and reinforcement are throughout the periphery of the door and within the overall area of the door so as to provide relatively few weak portions; (4) it is easy to operate the door in a normal manner; and (5) the door is relatively inexpensive. Even with cutting the rods, the locking arms will extend into the frame, thus preventing opening.

BRIEF DESCRIPTION OF THE DRAWINGS

The above noted and other features of the invention will be better understood from the following detailed description when considered in connection with the accompanying drawings in which.

DETAILED DESCRIPTION

Figure 1:
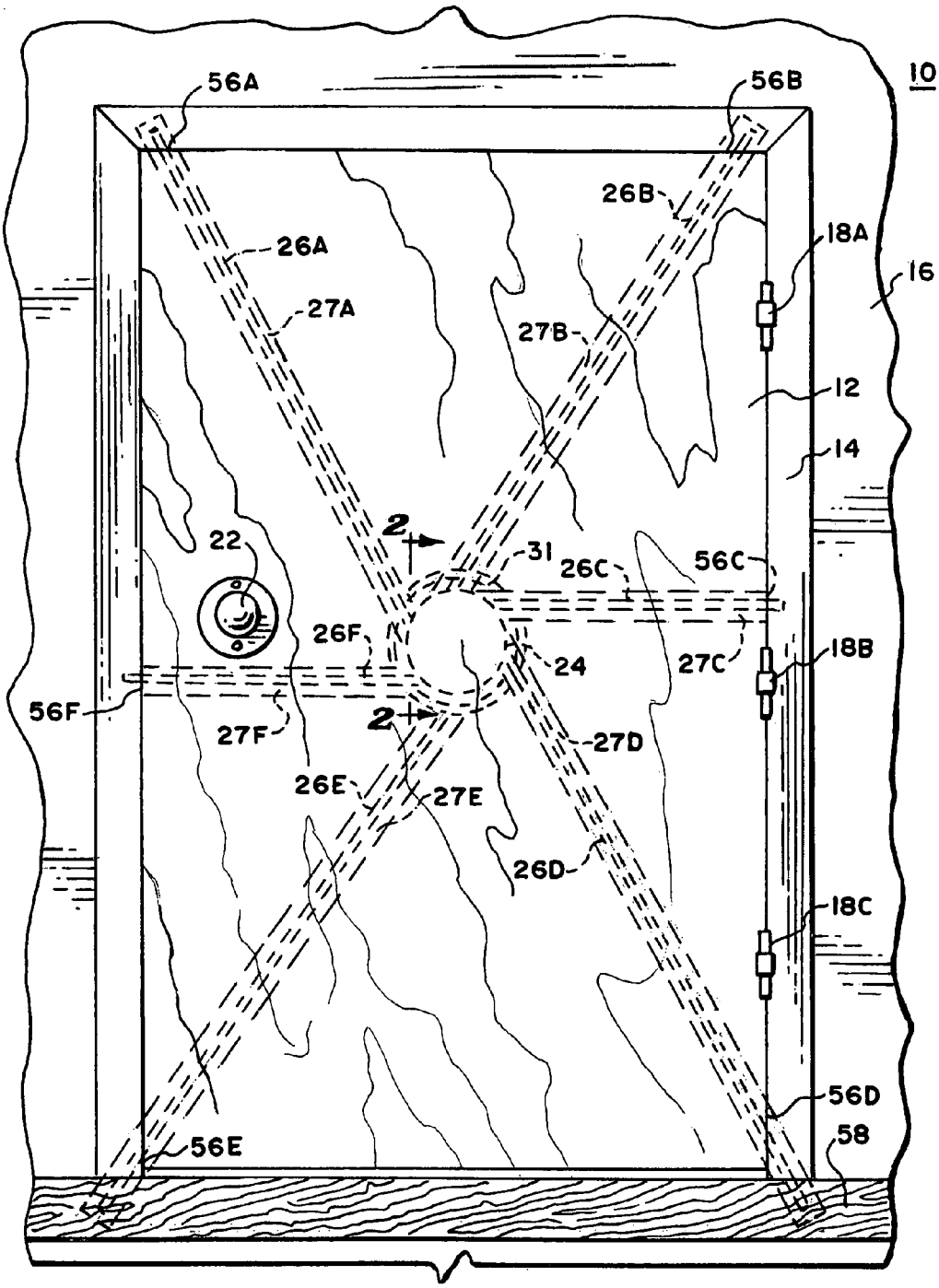
FIG. 1 is a simplified fragmentary elevational view of a safety door, doorway frame and building partly sectioned in accordance with an embodiment of the invention.
Figure 2:
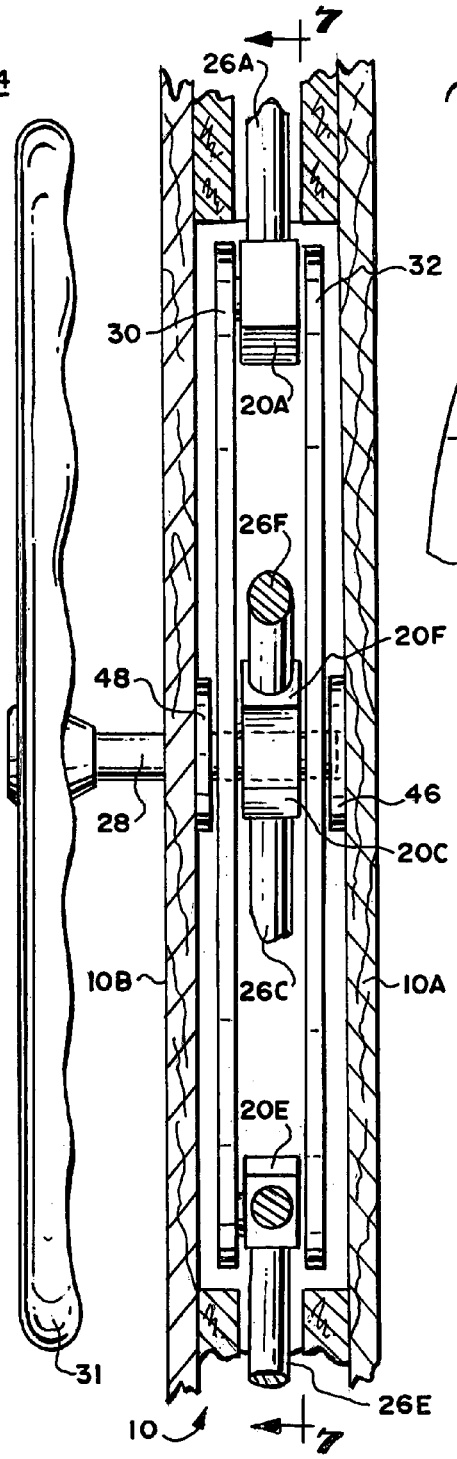
FIG. 2 is a simplified, fragmentary, partly-sectioned side view of an actuator mounted within the two faces of a door and having rods attached to the actuator for movement thereby as utilized in the safety door of FIG. 1 in accordance with an embodiment of the invention.
Figure 7:
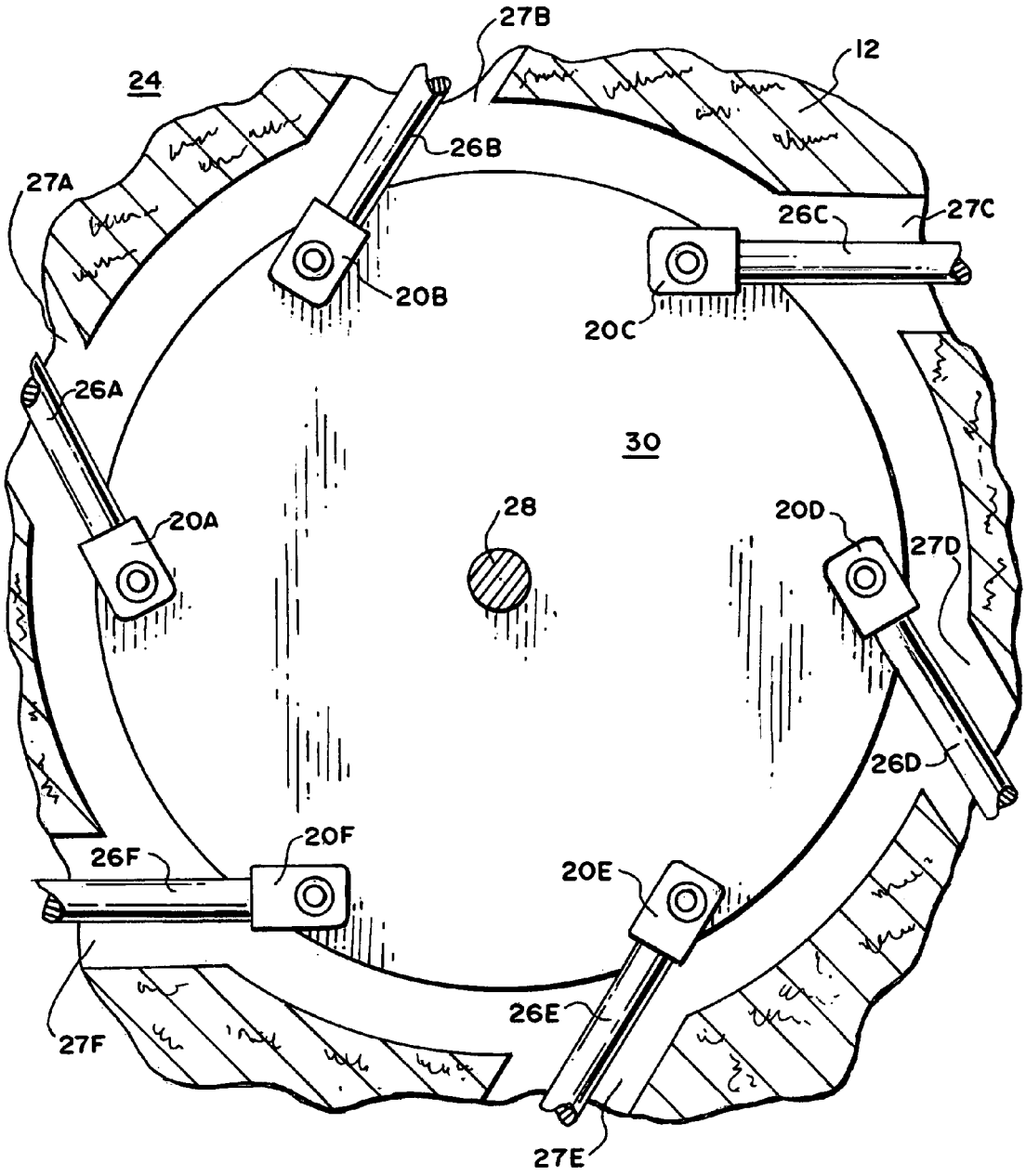
FIG. 7 is a sectional view of the actuator of FIG. 2 taken through lines 7-7 of FIG. 2.

In FIG. 1, there is shown a simplified fragmentary elevational view of a combination 10 of a safety door 12, a doorway frame 14, and a building wall 16 mounted together with the door 12 being a safety door. The safety door 12 has within it a centrally located actuator 24, a plurality of rods or bars 26A-26F, three hinges 18A-18C and a door knob 22. In the embodiment of FIG. 1, the central actuator 24 is rotatably pinned to the door by a pin 28 (FIG. 2). The rods 26A-26F are in communication at one of their ends (hereinafter referred to as a first end) with the actuator 24 so that rotation of the actuator 24 in one direction (clockwise in the embodiment of FIG. 1) forces the rods outwardly into the doorway frame 14 and/or floor to lock the door and rotation in the other direction (counterclockwise in the embodiment of FIG. 1) withdraws the rods 26A-26F from the frame 14 or floor so that the door 12 can be opened. The actuator 24 is activated in the preferred embodiment by gripping the edge 31 and moving it through an arc. However, other handles can be used as shown in the embodiment of FIG. 7 and described hereunder.

When the door 12 is closed, the bars 26A-26F resist the forcing of the door open. For this purpose, the bars have a thickness of at least 6 mm in their thickest dimension at an angle to their longitudinal axes, have a modulus of elasticity of at least 5,000,000 psi, and a yield point of at least 1,000 psi. In the preferred embodiment, they are solid aluminum cylindrical bars having a diameter of 12 mm but may be of many other materials and sizes. In the preferred embodiment, there are six rods although there may be between four and ten rods. With this arrangement, it is difficult to batter the door down. It can be secured from inside the building by simple rotation of the actuator 24 in one direction and can be placed in a rest condition where the door can be opened by simple rotation in the other direction of less than 90 degrees. In the preferred embodiment, the rotation is between 5 and 40 degrees. In most designs for doors, the rotation needed to insert the bars one inch into the doorway frame and a joist 58 in the floor is approximately 13 degrees and the angle increases in a manner substantially but not exactly proportionally to the distance.

In FIG. 2, there is shown a simplified, fragmentary partially sectional side view of the actuator 24, door 12 and rods 26A-26F (rods 26A, 26C, 26E and 26F only being shown in FIG. 2). As shown in this view, the actuator 24 includes two flat circular parallel spaced apart end plates 30 and 32 and a handle 31. It is mounted within a front face 10A and a rear face 10B of the door 12. The handle 31 in the embodiment of FIG. 2 is a wheel connected to the center of the end plate 30 by a pivot pin or connecting rod 28 that extends through a hole in the rear face 10B of the door 12 for rotation with the end plates. However, the edge of an end plate could serve as the handle with access being provided to the edge through an opening in the door or the handle may have another shape such as being L-shaped. The actuator rods 26A-26F are pivotally connected between the end plates 30 and 32 so that they are moved by rotation of the end plates 30 and 32. The end plates 30 and 32 rotate between two centrally located bearing plates 46 and 48 on the inside of the front and rear faces 10A and 10B respectively of the door 12.

The rods 26A-26F (only rods 26A, 26C, 26F and 26E being shown in FIG. 2) are pivotally connected to the actuator 24 by six cylindrical equally spaced apart tubular posts 34A-34F (not shown in FIG. 2 between the end plates 30 and 32. Although, in the preferred embodiment, the actuator 24 is cylindrical, it may take any other shape that can be moved to actuate the bars 26A-26F (FIG. 1). In the preferred embodiment, the actuator 24 is designed to actuate six bars and for that purpose each of the equally spaced apart cylindrical tubular connecting posts 34A-34F (not shown in FIG. 2) fits within a corresponding one of openings 21A-21F (not shown in FIG. 2) in corresponding ones of right regular parallelepiped bosses 20A-20F (only 20A, 20F and 20E being shown in FIG. 2). In the preferred embodiment, the posts 34A-34F are 0.5 inches aluminum tubes, the plates 30 and 32 are 8¾ inches in diameter and the posts are set in from the periphery by ¼ inch.

The ease of rotating the actuator 24 is reduced by the length of the rods and the number of the rods and increased by any mechanical advantage provided. The mechanical advantage is: (1) increased by the ratio of the distance of the handle 31 from the center of rotation to the distance of the ends of the rods 26A-26F from the center of rotation; (2) reduced by the sine of the angle between the rods 26A-26F and the radius of the center of rotation of the posts 34A-34F; and (3) increased proportionally to the diameter of the circle of rotation of the posts 34A-34F.

Figure 3:
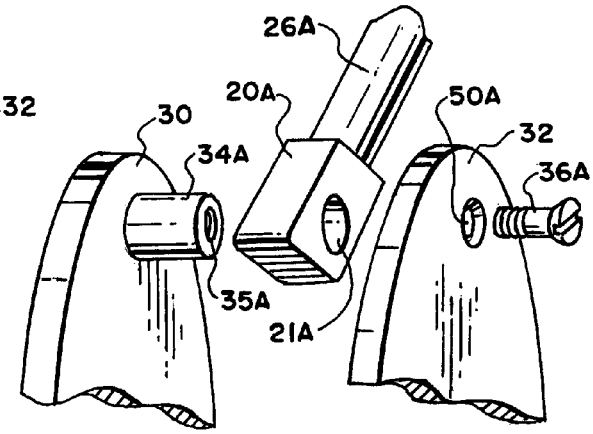
FIG. 3 is a fragmentary, exploded perspective view of a portion of the actuator end plates, one of the posts and one of the rods used in the embodiment of FIG. 1.

In FIG. 3, there is shown a fragmentary, exploded perspective view of a portion of the actuator end plate 30, a portion of the actuator end plate 32, one of the posts 34A, one of the rods 26A having a corresponding boss 20A and a machine screw 36A. The post 34A fits within an opening 21A and thus holds the rod 26A pivotally to the end plate 30. An opening 54 in the end plate 32 is aligned with an opening 35A in the post 34A. The opening 35A is tapped and a machine screw 36A holds the end plate 32, the boss 20A, the post 34A and the end plate 30 together. In the preferred embodiment, the rods are solid cylindrical 12 mm (millimeter) aluminum bars. The rods are relatively inexpensive and light in weight for easy assembly to the actuator.

Figure 4:
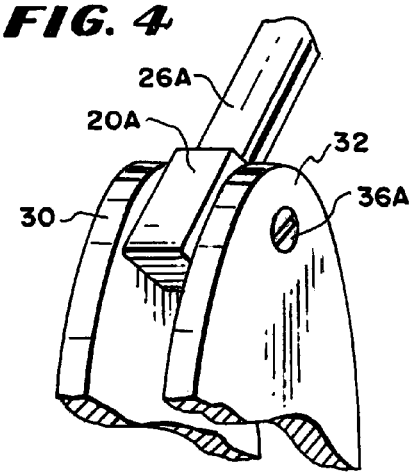
FIG. 4 is a simplified perspective view of a rod, end plates showing the parts of FIG. 3 assembled together.

In FIG. 4, there is shown a simplified perspective view of the rod 26A, the end plate 30, the end plate 32 and the screw 36A showing the parts of FIG. 3 assembled together. Thus, the rods 26A-26F are pivotally bolted at locations that place the rods 26A-26F within the doorway in the preferred embodiment or inside the room into which the safety door 12 opens. The machine screw 36A has a head larger than the opening 54 (FIG. 3) in the end plate 32. Each of the rods 26A-26F is connected to a corresponding one of the posts 34A-34F in a similar manner. This manner of connection permits the rods 26A-26F to move in a plane parallel to the doorway and outwardly within slightly elongated slots in the door and door frame. Although a specific mode of connection has been described, there are many other modes possible and known in the fastener art and the universal joint arts.

Figures 5, 6:
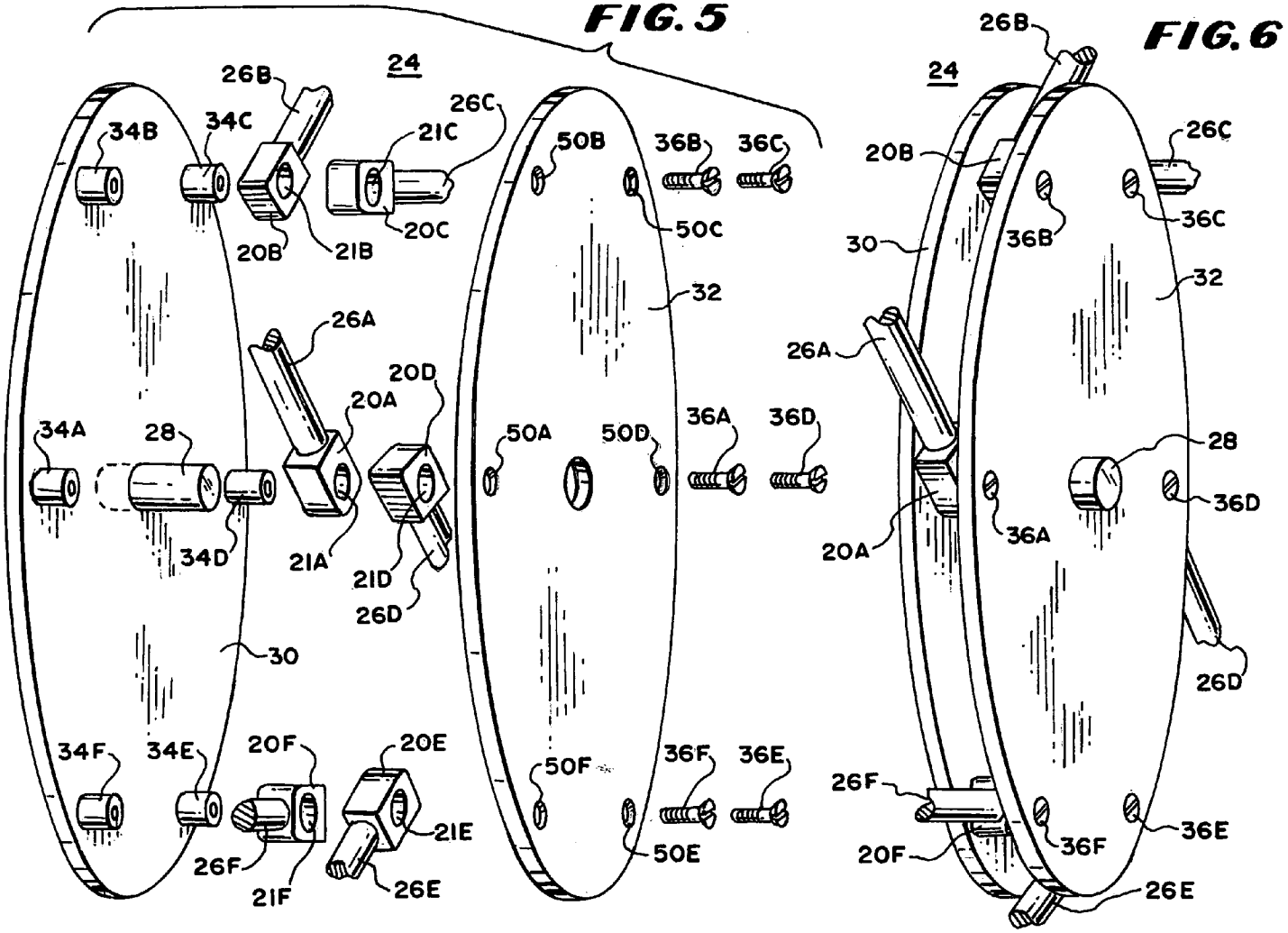
FIG. 5 is a simplified fragmentary exploded perspective view of an actuator used in the embodiment of FIG. 1 in accordance with an embodiment of the invention.
FIG. 6 is a simplified fragmentary perspective view of the actuator of FIG. 5.

In FIG. 5, there is shown a simplified fragmentary exploded perspective view of the actuator 24 with the six rods 26A-26F being adapted to be pivotally mounted between the end plates 30 and 32 with their respective central cylindrical openings 21A-21F in the corresponding bosses 20A-20F receiving the cylindrical posts 34A-34F. With this arrangement, as the actuator 24 rotates with the pivot pin 28 in the safety door 12, the bosses 20A-20F orbit about the pivot pin 28 and rotate about the corresponding posts 34A-34F over which they fit. To hold the end plates 30 and 32 together, the posts 34A-34F are attached to the end plate 30 and receive their corresponding machine screws 36A-36F in their tapped holes. The screw heads are outside of the actuator 24 and their shanks extending through the openings 50A-50F in the end plate 32 so that the end plate 32 is held to the posts 34A-34F to confine the bosses 20A-20F within the actuator 24.

In FIG. 6, there is shown a simplified perspective view of the actuator 24 showing the manner in which the actuator 24 is held together with the pivot pin 28 extending outward from the end plate 32 to rest moveably against the bearing plate 46 (FIG. 2). The bearing plate 48 (FIG. 2) has a central opening to permit the pivot pin to extend to the handle 31 (FIG. 2) for rotation therewith.

In FIG. 7, there is shown a fragmentary elevational sectional view of the actuator 24 and door 12 taken through lines 7-7 of FIG. 2 having the end plate 30, rods 26A-26F, pivot pin 28, door 12 and slots 27A-27F through which the rods 26A-26F extend. The slots 27A-27F are vertically elongated to permit the rods 26A-26F to move both radially outwardly from the actuator 24 through the door 12 and into the door frame 14 (FIG. 1) and floor joist 58 (FIG. 1) and at an angle to their longitudinal axes. This is necessary because the actuator 24 moves the inner end of the rods 26A-26F in an orbital curved path rather than only linearly along the direction of their longitudinal axes.

Figure 8:
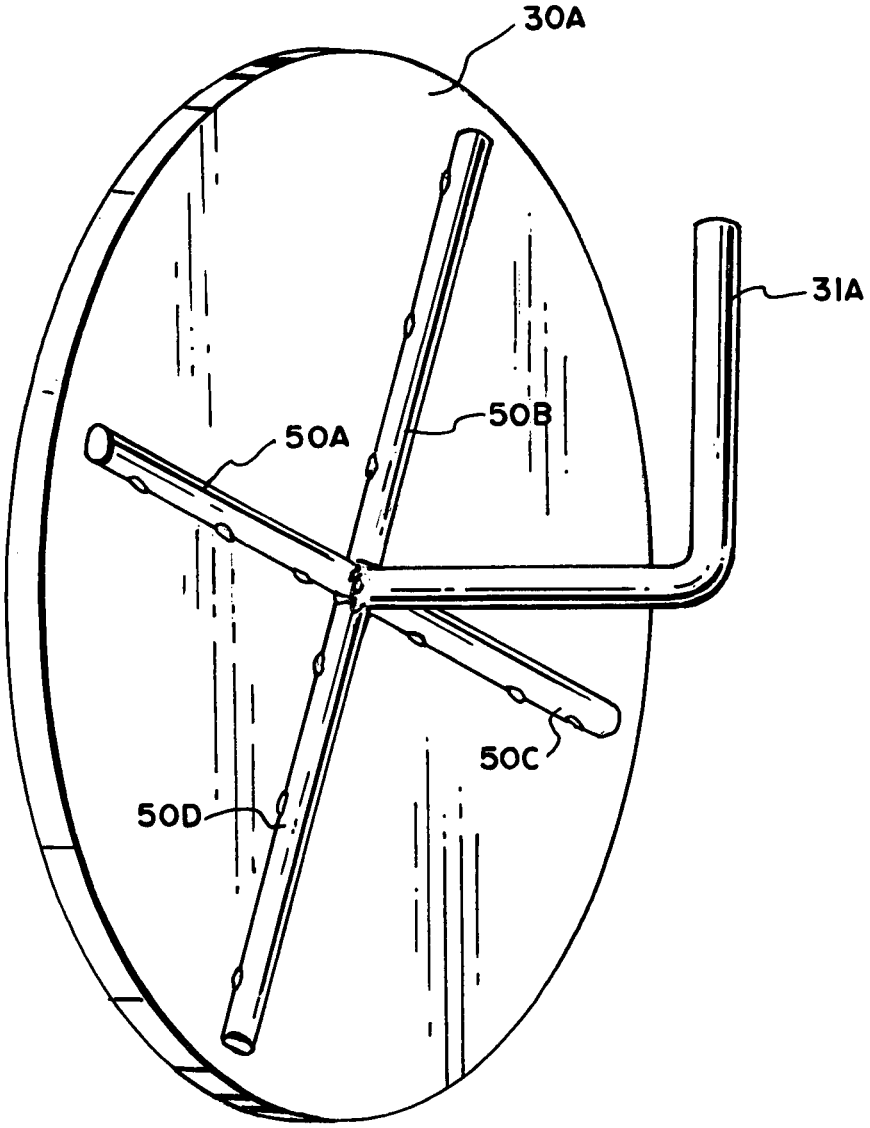
FIG. 8 is an simplified perspective view of another embodiment of handle for actuating the lock of a safety door in accordance with another embodiment of the invention.

In FIG. 8, there is shown a simplified perspective view of an embodiment of handle 31A and an end plate 30A for an actuator in accordance with an embodiment of the invention. In the embodiment of FIG. 8, supporting bars 50A-50D are connected to the end plate 30A and the handle 31A is connected to the supporting bars 50A-50D. The supporting bars 50A-50D meet at the center of the end plate 30A opposite from the pivot pin. The pivot pin is welded at the opposite side of the end plate 30A and extends perpendicularly therefrom through the opposite end plate to rest against a bearing plate in a manner similar to the embodiment of FIG. 1. The handle 31A extends perpendicularly from the intersection of the supporting bars 50A-50D to which it is welded through the back face of the door 12 and ends in a handle at an angle to the perpendicular to provide mechanical advantage sufficient to permit easy turning of the actuator 24 to lock the door.

Figure 9:
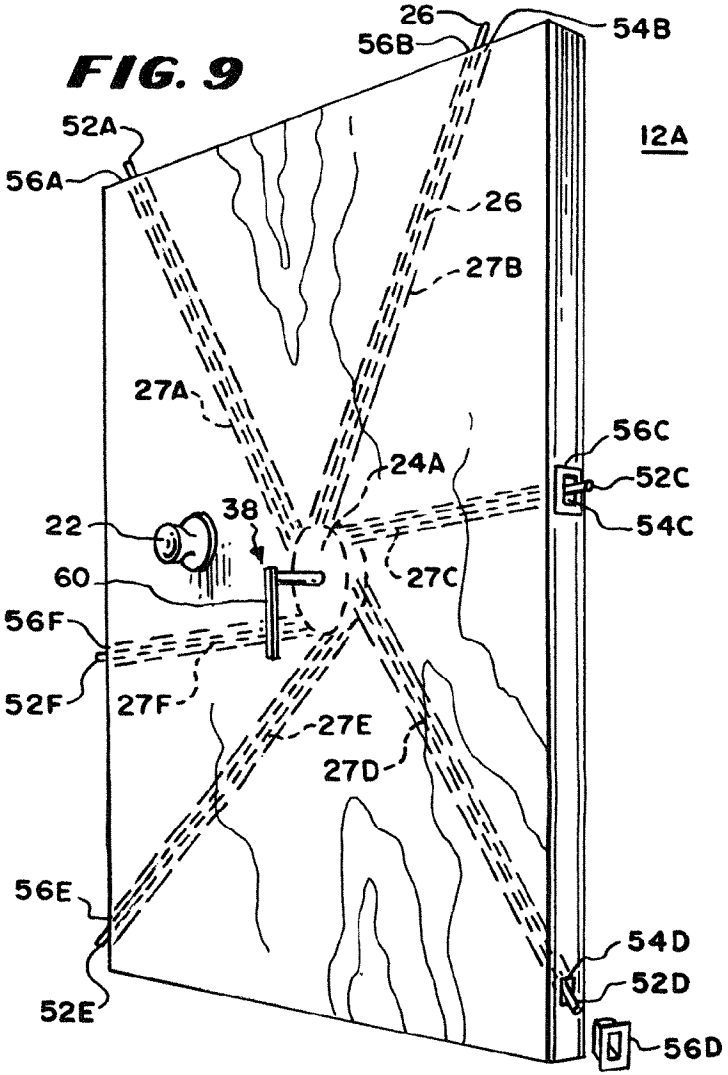
FIG. 9 is a simplified perspective view of another embodiment of safety door in accordance with another embodiment of the invention.

In FIG. 9, there is shown a simplified perspective partly exploded away view of another embodiment of door 12A similar to the embodiment 10 of FIG. 1 but being adapted to be locked and unlocked from outside the door. Generally, it is preferable to utilize the embodiment of FIG. 1 for security reasons, but under some circumstances it may be desirable to secure the door from outside against battering. For this purpose, a key 38 is provided in the form of a crank having a handle 60 for leverage. The key 38 is insertible through the front (outer) wall of the door 12A into an actuator 24A which is modified to receive the key 38. With this embodiment, the rods 26A-26F may be retracted or extended utilizing the key 38.

As best shown in FIG. 9, openings 54A-54F at the locations where the slots 27A-27F (herein sometimes referred to as laterally extending door slots) exit the safety doors 12 and 12A of FIGS. 1 and 9, are elongated in a plane parallel to the plane of the doorway. A corresponding one of the bushings 56A-56F is inserted into each of the openings 54A-54F. The bushings 56A-56F and the openings 54A-54F (herein sometimes referred to as doorway openings) in the doorway frames also have elongated slots. The elongated slots 27A-27F are necessary to accommodate the motion of the rods 26A-26F as the inner ends at the bosses 20A-20F (FIG. 7) are moved in an arcuate path by the actuator 24. The larger the angle through which the actuator 24 rotates the larger the slots must be. The angle is affected by the diameter of the circle formed by the posts 34A-34F (FIG. 5) which is selected to determine the mechanical advantage obtained by rotating the larger diameter handle 31. The distance the rods 26A-26F move into and out of the doorway frame 14 (FIG. 1) is determined by the angle of rotation of the actuator 24 and the diameter of the posts 34A-34F (FIG. 9). The bushings and slots are best illustrated at 56D, 52D and 54D where the bushing 56D is shown exploded away from the opening 54D.

Figure 10:
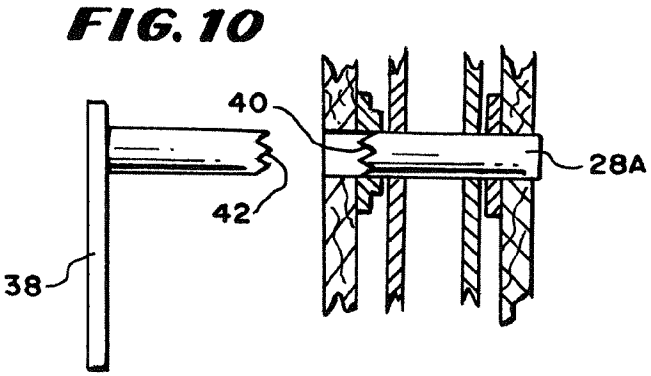
FIG. 10 is a simplified fragmentary view of the embodiment of FIG. 9 showing an arrangement for unlocking a safety door from outside the door.

In FIG. 10, there is shown the key 38 and an embodiment 28A of pin for the actuator 24A (FIG. 9). The pin 28A has on its end a uniquely shaped point which is shaped to correspond to the key 38. The key 38 has an opening 42 with a shape to match the uniquely shaped end 40 and thus permit engagement uniquely between the key 38 and the pin 28A for turning the pin to retract or extend the bars 26A-26F (FIG. 9) and thus lock or unlock the door 12A.

Figure 11:
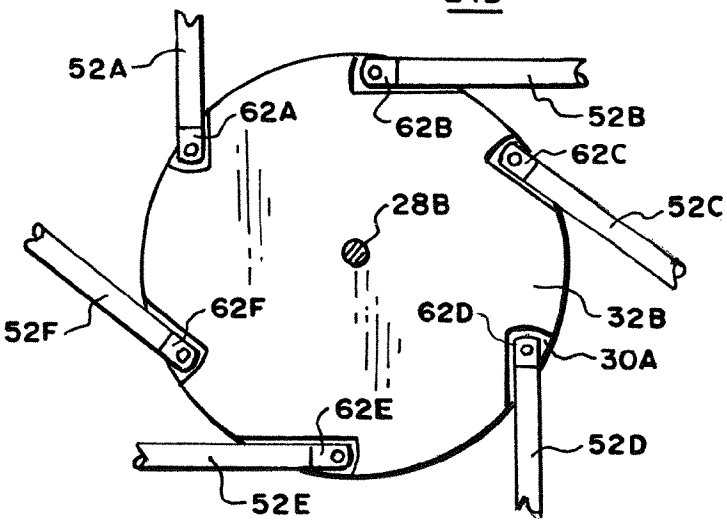
FIG. 11 is a simplified fragmentary elevational sectional view of another embodiment of actuator in accordance with an embodiment of the invention.

In FIG. 11, there is shown an elevational, fractionated sectional view, partly broken away, of another embodiment of actuator 24B having end plates 30B and 32B, rods 52A-52F, and a pivot pin 28B. The end plate 32B includes cut away portions showing the end plate 30B. The rods include flattened ends 62A-62F pivotally pinned to the end plate 30B. With this arrangement, the handle 31A (not shown in FIG. 11) may be rotated to lock and unlock the safety door. The rods are rotatably pinned directly to the actuator plate, thus reducing the depth of the actuator.

In operation, the safety door 12 is secured against battering or breaking to gain entrance to a room by turning the actuator 24 in a first direction and unlocked by turning it in the opposite or second direction. Turning the actuator 24 in the first direction moves the bars 26A-26F in a radially outward direction from their central location around the actuator 24 a sufficient distance so that their ends (herein sometimes referred to a second ends) extend into the doorway frame 14 far enough to prevent the door from being forcibly dislodged from the frame of the doorway. When locked, the safety door 12 resists breaking or cutting to gain entrance into a room. Turning the actuator in the second direction retracts the ends of the rods 26A-26F from the doorway frame 14 and permits the door to be opened by swinging it on its hinges 18A-18C such as by the door knob 22. In this specification, the floor including the joist 58 at the bottom of the doorway is considered part of the doorway frame 14. The bars 26A-26F extend at least one inch but preferably 1½ inches or more into the doorway frame 14 at six spaced apart locations on the door and extend all the way to a common point at an actuator 24 at the center so as to perform reinforcement throughout the door.

To permit the easy turning of the actuator 24 by hand to lock or unlock the door 12, the actuator 24 is pivotally pinned to the door 12 by the pin 28 (FIG. 2) at a central location on the door 12. A handle 31 (FIG. 2) extends from the actuator 24 inwardly into the room far enough to be easily grasped to manually turn the actuator. In the preferred embodiment, the handle 31 is "L" shaped but may be wheel shaped as shown in FIG. 2 or any other shape that can be easily grasped is adequate.

The handle is spaced at a sufficient distance from the pin 28 about which it and the rods 26A-26F rotate to provide enough mechanical advantage for easy turning against the resistance to motion of the bars. The larger the number of bars and the greater the length, the greater the resistance and the larger the distance between the pin 28 and the handle 31 to which force is applied to lock or unlock the safety door 12. The mechanical advantage is the ratio between a first distance, which is the distance between the handle 31 and the pin 28, and a second distance which is the effective distance between the points at which the inner ends of the bars 26A-26F are attached to the posts 34A-34F. In the preferred embodiment, the bars 26A-26F are all pivoted about points that are at the same distance from the pin 28 and so the effective distance is the actual distance. However, in this specification, the effective distance is that distance that would provide the same mechanical advantage if the distances were all the same and the resistance to motion provided by each bar is the same. If the resistance provided by each bar is the same, the effective distance is generally the average distance.

In the preferred embodiment, the actuator 24 is rotated through 15 degrees in a first direction to lock the door and 15 degrees in the opposite direction to unlock the door. However, it may be designed for different amounts of rotation depending on the distance into the doorway frame the rods 26A-26F are to extend and the diameter of the rotary member. In one embodiment, the door is only locked and unlocked from inside. However, in other embodiments, a key 38 with a hollow specific shape on its outer end may be inserted through the door into a special pin 28A with a correspondingly shaped end so as to move the actuator 24 from outside the door. The pin is fastened to the plates 30 and 32 for movement therewith.

Although a preferred embodiment of the invention has been described with some particularity, many modifications and variations in the invention are possible in the light of the above teachings. Therefore, it is to be understood, that, within the scope of the appended claims, the invention may be practiced other than as specifically described.

What is claimed is:

1. A system comprising:

a doorway frame; and a safety door, the safety door comprising:

an actuator configured to be rotated to lock and unlock the safety door to the doorway frame;

radially extending bars coupled to the actuator and mounted in the safety door such that each of the radially extending bars is configured to be extended radially from one of a plurality of laterally extending door slots into the doorway frame in response to the actuator being rotated; and a door core having:

an actuator opening configured to receive and support the actuator while allowing the actuator to be rotated, and radially extending openings, wherein:

each of the radially extending openings receives one of the radially extending bars; and each of the radially extending openings of the door is configured to permit both lateral and longitudinal movement of the radially extending bars resulting from each of the radially extending bars pivoting about a point in an arcing motion in response to the actuator being rotated.

2. The system of claim 1 further including:

a handle extending from the safety door; and wherein:

the actuator is round and has a center of rotation;

each of the radially extending bars has a first end configured to be pivotally connected to the actuator at locations radially spaced from the center of rotation and circumferentially spaced from each other for rotation within the safety door, whereby the rotation of the actuator orbits the first end of each of the radially extending bars;

the handle is connected to the actuator to rotate the actuator about the center of rotation; and the first end of each of the radially extending bars being spaced from the center of rotation at a distance that provides mechanical advantage to movement of the handle.

3. The system of claim 2, wherein movement of the handle through a first distance causes movement of the first end of each of the radially extending bars through a second distance, wherein the second distance is shorter than the first distance.

4. A safety door comprising:

a door core;

laterally extending door slots in the safety door;

an actuator having a center of rotation;

a plurality of bars radially extending at spaced apart locations from the actuator;

the actuator configured to be pivotally mounted within the safety door for rotation therein about the center of rotation;

each of the bars having a first end pivotally mounted to the actuator at circumferentially spaced apart locations about the center of rotation;

each of the bars having a second end configured to be retracted into laterally extending door slots in the safety door by rotation of the actuator in a first direction and extended from the laterally extending door slots in the safety door by rotation of the actuator in a second direction;

the door core including radially extending openings extending in the direction of the bars, wherein the bars are supported by and move within the radially extending openings; and each of the radially extending openings in the door core extending in the direction of a corresponding one of the bars and configured to be sufficiently larger than the diameter of each of the bars to permit both lateral and longitudinal movement of each of the bars within the radially extending openings and the laterally extending door slots, wherein the lateral and the longitudinal movement of the bars results from each of the bars pivoting about a point in an arcing motion in response to the actuator being rotated.

5. The safety door of claim 4, wherein the bars are six in number.

6. The safety door of claim 4 further including:

a handle extending from said safety door;

a first end of each of the bars is configured to be pivotally connected to the actuator at circumferentially spaced apart locations about the center of rotation and orbiting about the center of rotation as the actuator rotates;

the handle is connected to the actuator to rotate the actuator, wherein the first end of each of the bars is orbited as said central the actuator is rotated; and the first of each of the bars being spaced a distance from the center of rotation, the distance being set to provide sufficient mechanical advantage to movement of the handle to permit easy extending and retraction of the bars.

7. The safety door of claim 6, wherein the movement of the handle causes movement of the bars wherein the distance the bars travel never is shorter than the distance the handle moves.

8. A method of locking a door comprising:

closing the door;

actuating an actuator centrally located within a door core of the door by moving a handle connected to the actuator;

moving a plurality of bars radially through openings in the door core into a doorway frame at spaced apart locations, wherein moving of the bars comprises moving the bars laterally and the longitudinally resulting from each of the bars pivoting about a point in an arcing motion within the openings configured to accommodate such motion; and wherein:

the actuating of the actuator includes rotating the actuator about a center of rotation and orbiting a first end of each of the bars about the center of rotation, wherein the first end of each of the bars is pivotally mounted to the actuator at circumferentially spaced apart locations about the center of rotation.

* * * * *